United States Patent [19]

Perrin

[11] 4,443,204

[45] Apr. 17, 1984

[54] HYDRO-THERAPY APPARATUS

[76] Inventor: Arden Perrin, 15 Boulevard Louis II, Monte Carlo, Monaco

[21] Appl. No.: 337,390

[22] Filed: Jan. 6, 1982

[30] Foreign Application Priority Data

Jul. 24, 1981 [GB] United Kingdom ..... 8122905

[51] Int. Cl.[3] ..... B63B 35/00

[52] U.S. Cl. ..... 441/129; 434/262

[58] Field of Search ..... 441/129–132, 441/35, 44–46, 80, 88, 81; 114/61; 434/254, 262

[56] References Cited

U.S. PATENT DOCUMENTS

| | | | |
|---|---|---|---|
| 1,297,665 | 3/1919 | Edmonds | 441/81 |
| 2,246,267 | 6/1941 | Sanches | 441/35 |
| 3,373,991 | 3/1968 | Smalley | 434/254 |
| 4,019,214 | 4/1977 | Shaw | 441/80 |

FOREIGN PATENT DOCUMENTS

| | | | |
|---|---|---|---|
| 1254259 | 1/1961 | France | 441/35 |
| 4190 | of 1914 | United Kingdom | 441/88 |

*Primary Examiner*—Sherman D. Basinger
*Attorney, Agent, or Firm*—Larson and Taylor

[57] ABSTRACT

Apparatus for use in hydro-therapy comprises a pair of parallel rods 2 extending between rigid flotation bodies 4. Each rod 2 is formed at each end with a vertical extension 6 passing through a slot 8 in the respective body 4. Each extension 6 is screw threaded and carries clamping nuts 12 and 14 respectively above and below the upper and lower surfaces of the body 4. Adjustment of the spacing between the rods 2 is obtained by relative movement of the extensions 6 along the slots 8 and vertical adjustment of the rods 2 is obtained by nuts 12 and 14.

7 Claims, 4 Drawing Figures

HYDRO-THERAPY APPARATUS

BRIEF SUMMARY OF THE INVENTION

Hydro-therapy, i.e. the carrying out of exercises by a patient while at least partially immersed in water, is a useful tool in the treatment of muscles and joints, particularly when the latter are the subject of some form of rheumatic and/or arthritic disease. Many of the exercises, particularly those involving the hip joints, require the joint or hoints to be in a non-load-bearing condition and hence that the patient be supported freely in the water. For this purpose a common practice is to support the patient in an upright attitude by means of a pair of parallel rods or bars arranged just above the surface of the water and passing beneath his armpits. It is important that the spacing between the rods or bars should be equal to the width between the armpits of the patient and for this reason the rods or bars must be adjustable in relation to one another.

Supporting a patient in an upright attitude requires a corresponding depth of water and in practice the rods or bars are set up across the width of a relatively large pool which means that they must be fairly rigid and heavy and their adjustment is thus relatively heavy work. Quite apart from this, the presence of the bars precludes the use of the pool for swimming or other purposes and consequently hydro-therapy pools are few and far between.

An alternative practice, therefore, is to support the patient in a more nearly horizontal position by means of two or more floats similar to life belts or life jackets. This requires much less depth of water and a smaller volume, e.g. a tank rather than a pool, but is not nearly so effective since the range of exercises which can be carried out is very limited and the patient's movements are restricted by the presence of the floats.

The primary object of the present invention is the provision of apparatus which enables a patient to exercise in an upright and/or horizontal position without the need for the heavy rods or bars extending across the width of a pool. According to the invention such apparatus comprises a pair of parallel rods or bars extending between a pair of rigid flotation bodies and including means for securing the rods or bars to the bodies in such a way that the spacing between them is adjustable. Since the apparatus as a whole is buoyant, it does not need to be supported across the width of a pool and, as a consequence, the rods or bars may be made much shorter and hence thinner and lighter. The overall length, including the flotation bodies, need not be more than about three or four feet, thus making it possible to use the apparatus in a normal swimming pool and without the need for a specially equipped hydro-therapy pool. If the pool is a public one, it may be possible for the apparatus to be used in one corner without impeding swimming in the remainder of the pool or, alternatively, the pool may be closed for swimming for a set period of time and the whole pool utilised by a number of patients, each with his own individual apparatus adjusted to his own shoulder width.

Preferably the securing means is such as also to permit adjustment of the rods or bars in relation to the bodies in a direction perpendicular to the common plane of the rods or bars. In other words, when the apparatus is in its operative position floating on water with the rods or bars extending horizontally, this allows the rods or bars to be adjusted in a vertical direction.

This is of importance in ensuring that the patient is immersed to the correct depth in the water, generally with the chin just above the water surface. The adjustment required will depend mainly on the size of the patient, i.e. the vertical distance between the armpits and the chin, but this will be affected to a certain extent by the weight of the patient since this will affect the depth of immersion of the apparatus as a whole. In practice, however, the depth of immersion will vary by only a very small amount because the patient's body will be immersed and will thus be virtually weightless and it is only the weight of the head and neck which needs to be supported by the flotation bodies.

In general, the two adjustments, i.e. the width between the rods or bars and their vertical height will go together. In other words, a large patient will require the rods or bars to be further apart and lower in relation to the floats than a smaller patient. In order to facilitate making both adjustments together, each rod or bar may include an extension at each end lying in a plane perpendicular to the common plane of the rods or bars, the extensions lying in transverse slots in the respective flotation bodies, within which they are capable of adjustment in the two perpendicular directions. The horzontal adjustment, i.e. the width between the rods or bars, is then carried out by moving the extensions along the lengths of the slots and the vertical adjustment is carried out by moving the extensions up or down across the width of the slots. For this purpose, each extension may conveniently be provided with a pair of nuts engaging corresponding threaded portions of the extensions and, when tightened, engaging the respective flotation body to clamp the extension in position. In order to obtain the horizontal adjustment, it is only necessary to slacken off the upper nut, slide the extension along the slot and then tighten the nut again. In order to carry out the vertical adjustment, both nuts on each extension need to be adjusted, e.g. the upper nut slackened off and the lower nut tightened in order to move the associated rod or bar in a downward direction.

Other features of apparatus in accordance with the invention can best be described with reference to the accompanying drawings, in which:

DETAILED DESCRIPTION

Figure 1:
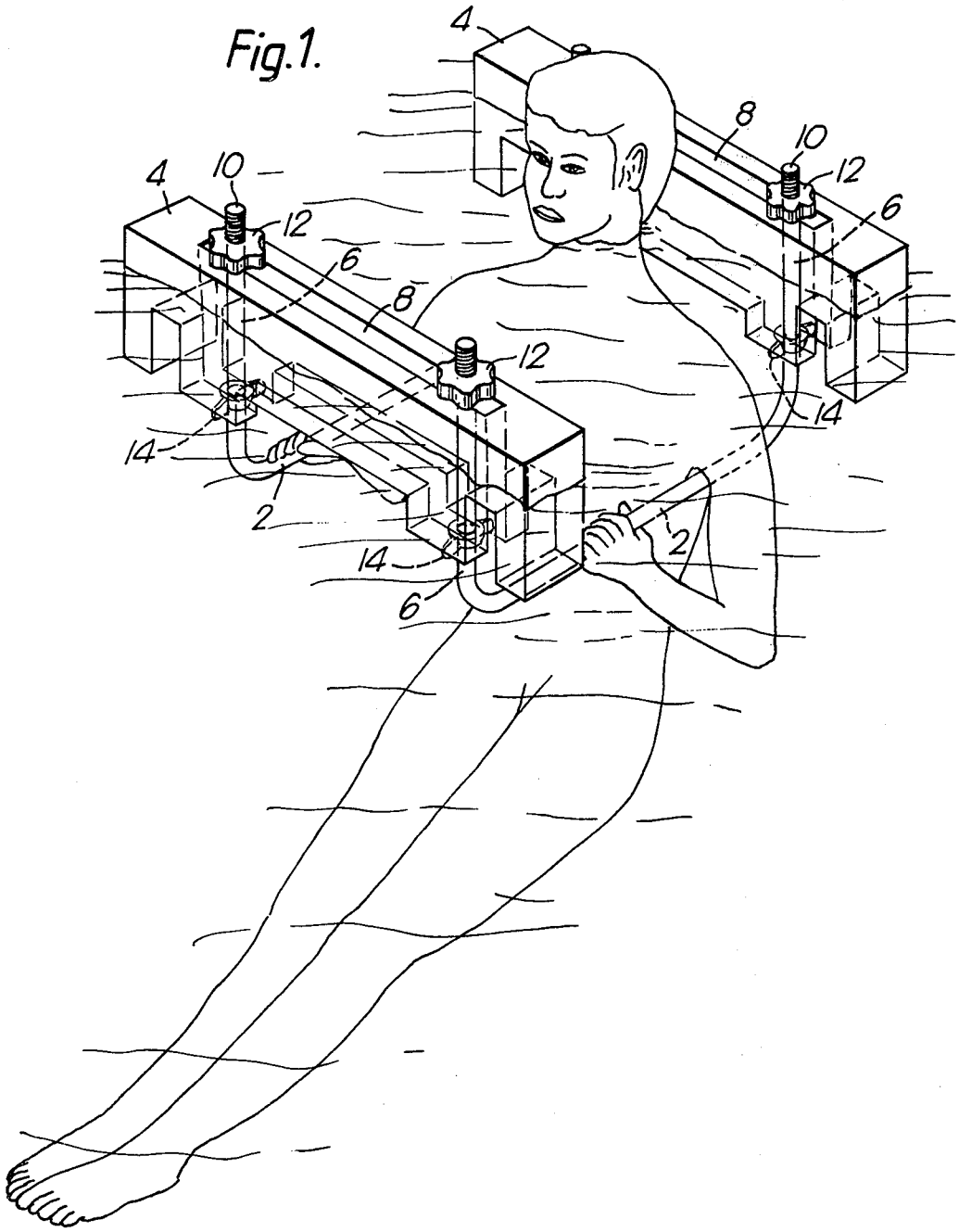
FIG. 1 is a perspective view showing the apparatus in use.

FIG. 1 shows the apparatus in use, that is to say floating in water with a patient supported with his head just above the water level, in other words, with his chin just clear of the water. The apparatus comprises a pair of parallel rods 2 each of approximately one inch diameter extending between rigid flotation bodies 4 which may either be hollow or formed of foamed plastics material. Each rod 2 is formed at each end with a vertical extension 6 which passes through a transverse slot 8 in the respective flotation body 4 so as to extend at the top as indicated at 10. Each extension 6 is screw threaded and carries a nut 12 immediately above the upper surface of the respective flotation body 4 and a further nut 14 immediately below the lower surface of the flotation body 4. The nuts 12 and 14 are tightened up so as to grip the flotation body between them and thus to hold the rods 2 in the position illustrated.

When the nuts 12 and 14 are slackened off, the extension 6 can be moved along the slot 8 so that the distance between the rods 2 can be adjusted in accordance with the corresponding dimension of the patient, that is to say the distance between his armpits. When the adjustment has been made, the nuts are tightened up to clamp the rods 2 in the adjusted positions. Adjustment is also possible in a vertical direction by slackening one of the nuts on an extension 6 and tightening up the other. Thus, to lower the rods 2 from the position shown in FIG. 1, the nuts 12 are slackened, thus allowing the associated extensions 6 and rods 2 to move downwardly together with the nuts 14. The nuts 14 are then tightened up again to grip the lower side of the respective flotation body 4 and thus to clamp the rods 2 in the adjusted position. As previously explained, this vertical adjustment is necessary in order to allow for the differing dimensions between the armpits and chin of different patients so that, whatever the size of the patient, he is supported in the correct position with his chin just clear of the water surface. When the patient is supported in this position, the top of the left hand flotation body comes in his direct line of sight and if desired, the top of the flotation body may be slightly recessed in this region in order to avoid any sensation of claustrophobia in the patient.

Figure 2:
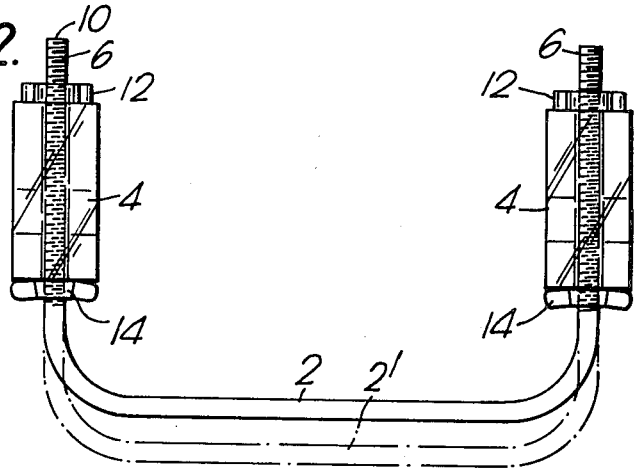
FIG. 2 is a side view showing alternative vertical positions of the rods or bars.

The feature of vertical adjustment is illustrated most clearly in FIG. 2 where the highest position of the rods 2 is shown in full lines and corresponds to the nuts 14 being screwed down to the lower end of the screw threads on the extensions 6. The lowest position of the rods is shown in dotted lines as 2' and corresponds to the nuts 12 being situated at the upper ends of the threaded extensions 6.

Figure 3:
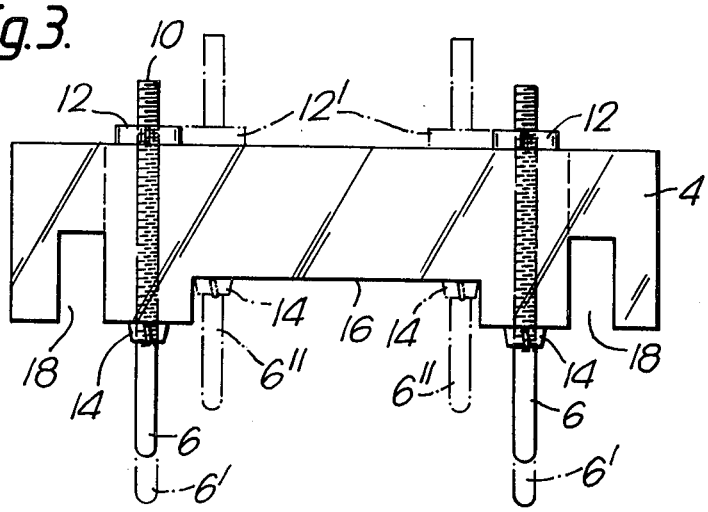
FIG. 3 is a front view showing alternative positions of the rods or bars to adjust the horizontal spacing.

As can be seen from the drawings, each flotation body 4 is formed with flat surfaces which join one another at right angles to form square edges and corners. It is found that this form of shaping i.e. without any form of streamlining leads to general turbulence and eddying of the water when the apparatus is in use and that this, in turn, has a beneficial effect on the patient. This effect is further enhanced by the provision of recesses on the lower edge of the flotation bodies, which serves to trap any eddies which are formed and thus help them to persist. The shaping of these recesses is best seen in FIG. 3 in which the lower edge of the flotation body 4 is seen to have a central recess 16 and two narrower, deeper outer recesses 18. As with all the other surfaces of flotation body 4, the surfaces of these recesses are flat and the corners are not rounded to any appreciable extent.

The effect of the combination of the recesses 16 and 18 is to define pairs of downward projections on each side which act as stabilising fins. As illustrated, the outer projections 19 are narrower than the inner projections 20, but if the recesses 18 are located closer to the centre of the flotation body 4, the outer projections 19 are broader than the projections 20, which may be advantageous from the point of view of additional stability.

Under normal conditions of adjustment, the nuts 14 engage the lower edge of the flotation body 4 over the surface between the central recess 16 and the outer recesses 18. According to the relative positions of the nuts 12 and 14, the extensions 6 can be adjusted between an upper position shown in full lines and a lower position shown in dotted lines as 6', as previously described. For a particularly small patient, e.g. a child or a small woman, the width between the two rods 2 may need to be reduced to a value illustrated by the inner dotted line positions of the extensions 6 shown as 6". It will be seen that this is inside the inner limit of the lower edge of the body 4 extending between the recesses 16 and 18 and that the nuts 14 are consequently in engagement with the lower edge of the recess 16. In order to ensure that when in the position 6", the extensions 6 should be as close as reasonably possible to the outer edges of the recess 16, each nut 14 has a dimension in one direction which is small in relation to that of the nuts 12. In practice, this dimension is only slightly greater than the thickness of each extension 6 so that the space between the extension 6 and the edge of the recess 16 is of this same order. In order to provide sufficient purchase when turning the nuts 14, the dimension at right angles to that illustrated in FIG. 3 is considerably greater, as can be seen, for example, in FIG. 2, giving each nut an overall propeller-like outline. Of course, the nuts 14 cannot be turned when in the position illustrated in FIG. 3 and in order to reach this position, each nut 14 is adjusted to its correct position while the extension 6 is spaced a sufficient distance from the edge of the recess 16. The extension 6 is then slid along the slot 8 until the position of FIG. 3 is reached and the final tightening is effected by means of the nut 12.

Figure 4:
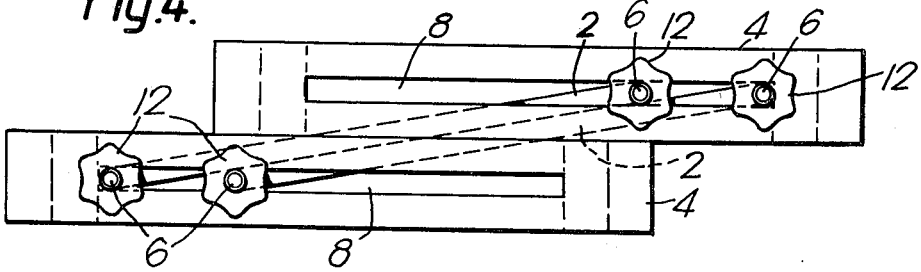
FIG. 4 is a plan view showing the apparatus in a folded position.

Both the rods 2 with their extensions 6 and pairs of nuts 12 and 14 and also the flotation bodies 4 can be light-weight in construction and the apparatus as a whole may weigh as little as six pounds. For carrying purposes, the apparatus may be dis-mantled by removing the nuts 12 and sliding the extensions 6 out of the slots 8. This enables a minimum volume to be achieved, e.g. during packaging prior to sale. Generally speaking, this minimum volume is not required during normal use, but a greatly reduced volume can be obtained without dis-assembly merely by slackening the nuts 12, sliding both extensions 6 at one end towards the same end of the slot 8 and then folding the apparatus to the collapsed configuration shown in FIG. 4. Here it will be seen that the two flotation bodies 4 are in contact with one another and that the rods 2 are displaced to slope at an acute angle to the slots 8. The overall length of the apparatus in this configuration is somewhat greater than the length of the individual flotation members 4, but the convenience of retaining the apparatus as a single assembly without the risk of losing any of the individual components more than compensates for the slight additional length.

I claim:

1. Hydrotherapy apparatus for supporting a patient in a body of water comprising a pair of flotation bodies, a pair of parallel bars extending substantially horizontally between the flotation bodies and having vertically oriented end portions extending upwardly through the flotation bodies such that a patient may be supported in a generally vertical position in the body of water by the parallel bars disposed under the armpits of the patient and with the flotation bodies being disposed in front of and behind the patient and adjustable means for securing said bars to said flotation bodies whereby the spacing between said bars is adjustable to position the bars under the armpits so that the patient may be supported in the body of water between the flotation bodies.

2. Apparatus according to claim 1 wherein said securing means is such as also to permit adjustment of said bars in relation to said flotation bodies in a direction perpendicular to the common plane of said bars.

3. Apparatus according to claim 1, wherein each said end portion is formed with screw-threaded portions, said apparatus including pairs of nuts engaging corresponding threaded portions of said end portions, each said pair of nuts when tightened engaging opposite faces of said respective flotation body whereby to clamp the respective end portion in position.

4. Apparatus according to claim 3 wherein each said flotation body has a central, flat-surfaced recess and two narrower, deeper outer flat-surfaced recesses formed in its edge adjacent said parallel bars and said nuts which engage said edge of said respective flotation body adjacent said parallel bars, each have a transverse dimension in one direction only slightly greater than the thickness of said extension.

5. Apparatus according to claim 1 wherein each said flotation body is formed with flat surfaces joining one another substantially at right angles to form square corners whereby to promote water turbulence during use.

6. Apparatus according to claim 5 wherein each said flotation body is formed in its edge adjacent said parallel bars with at least one flat-surfaced recess.

7. Apparatus according to claim 6 wherein each said flotation body has a central, flat-surfaced recess and two narrower, deeper outer flat-surfaced recesses.

* * * * *